United States Patent [19]

Fang

[11] Patent Number: 4,746,154

[45] Date of Patent: May 24, 1988

[54] TUBULAR LOCK WITH AN ADJUSTABLE DEVICE FOR TWO-SIZE SETTING

[75] Inventor: Yau C. Fang, Chiaya, Taiwan

[73] Assignee: Posse Lock Manufacturing Co., Ltd., Chiayi, Taiwan

[21] Appl. No.: 9,889

[22] Filed: Feb. 2, 1987

[51] Int. Cl.[4] ..... E05C 1/16

[52] U.S. Cl. ..... 292/337; 292/169; 292/1

[58] Field of Search ..... 292/337, D60, 169, 1

[56] References Cited

U.S. PATENT DOCUMENTS

| | | | |
|---|---|---|---|
| 2,795,447 | 6/1957 | Schlage | 292/337 |
| 3,441,269 | 4/1969 | Doyle | 292/337 |
| 4,427,224 | 1/1984 | Bergen | 292/1 X |
| 4,468,059 | 8/1984 | Nelson et al. | 292/337 |
| 4,516,798 | 5/1985 | Bergen | 292/169.13 |
| 4,615,549 | 10/1986 | Couture | 292/337 X |
| 4,623,174 | 11/1986 | Trull et al. | 292/1 |
| 4,639,025 | 1/1987 | Fann et al. | 292/337 |

*Primary Examiner*—Gary L. Smith
*Assistant Examiner*—Eric K. Nicholson
*Attorney, Agent, or Firm*—Holman & Stern

[57] ABSTRACT

This tubular lock has a device that can adjust its size into two kinds for fixing on a door. The device utilizes the movement of an extending plate and an auxiliary plate, changing their positions to either of the two sizes, but the lock still works in spite of the size change.

6 Claims, 5 Drawing Sheets

TUBULAR LOCK WITH AN ADJUSTABLE DEVICE FOR TWO-SIZE SETTING

When fixing a tubular door lock in a door, a long latitudinal groove needs to be cut on the side surface of a door so as to fix the lock in, and a turning hole is cut in the front surface of the door to fit the intersecting crossed hole of the lock. The crossed hole is a rotatable member having a cross-shaped opening.

Usually, locks nowadays manufactured are divided into two sizes, representing different distances between its crossed hole and faceplate. Therefore, in order to satisfy different needs, manufacturers have to manufacture two different sizes of locks, retailers are obliged to have more space for stocking them and buyers, unless having knowledge of locks, may feel at a loss in selecting them.

SUMMARY OF THE INVENTION

In view of the above mentioned, the inventor has worked out this tubular lock with an adjustable device for fixing in either of the two sizes on a door, in order to facilitate the manufacturing process, the selling and using of the locks.

This invention attains the purpose of adjusting the distance between the crossed hole and the faceplate into 60 mm or 70 mm by making use of an extending plate and an auxiliary extending plate which are changable in their location to two points and still capable to make this lock work.

DETAILED DESCRIPTION OF THE INVENTION

Figure 1:
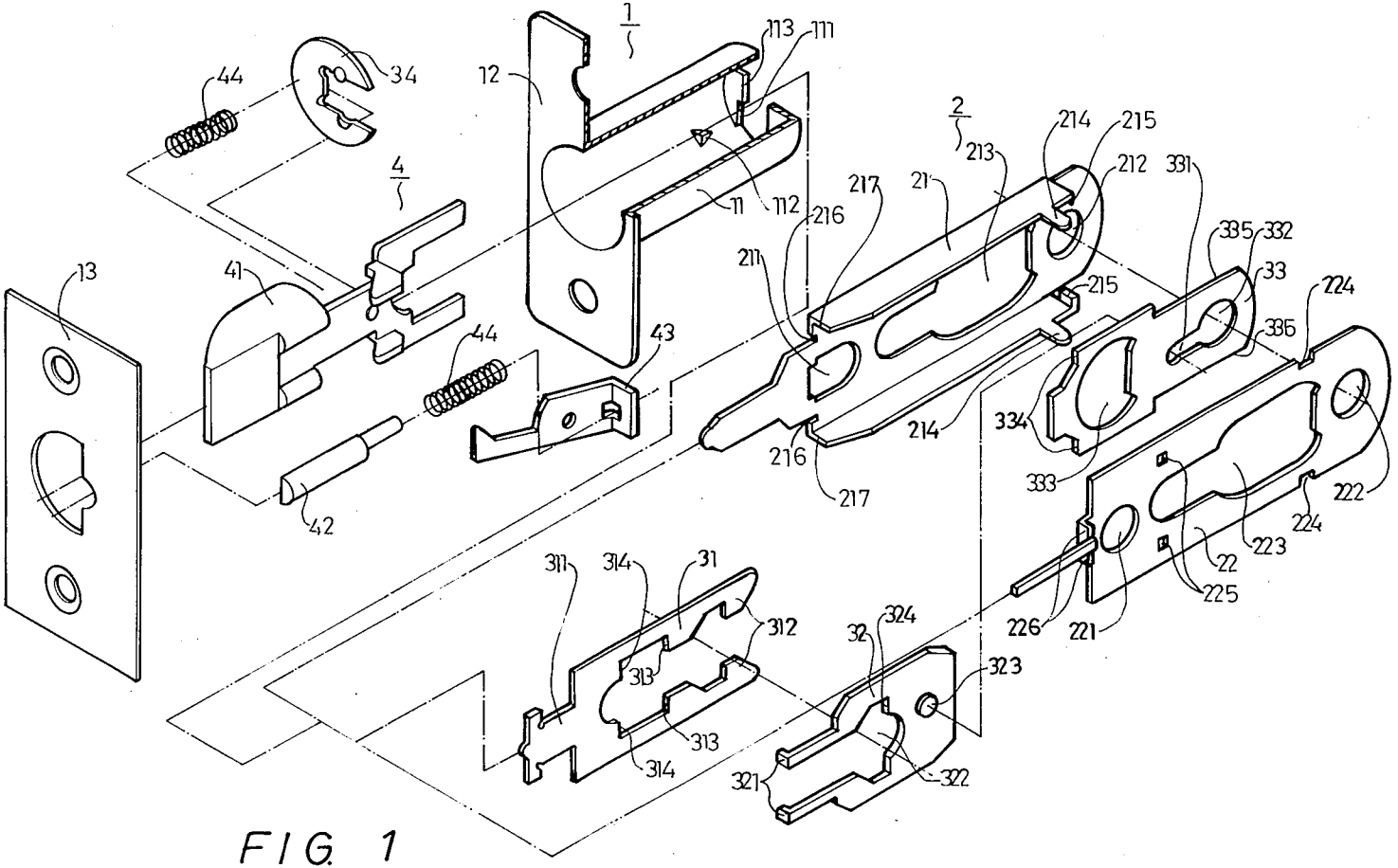
FIG. 1 is the view of the seperated parts of the tubular lock with an adjustable device for two-size setting in this invention.

As FIG. 1 shows, this lock is constructed of four main divisions, lock cylinder 1, combining set 2, moving set 3, and anti-burglar set.

Lock cylinder 1 includes cylinder 11, faceplate 12 and fixing plate 13; cylinder 11 has hole 111 for combining set 2 to combine with, and stopping key 112 for keeping releasing plate 34 at its place.

Figure 2:
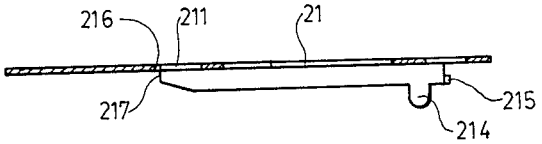
FIG. 2 is the cross-section view on the line 2—2 of FIG. 3.
Figure 3:
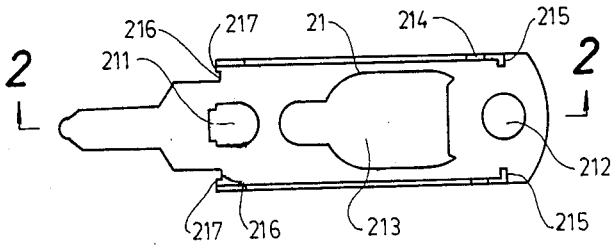
FIG. 3 is a front view of the outer combining plate in this invention.

Combining set 2 includes outer combining plate 21 and lid plate 22; outer combining plate has a construction as FIGS. 1 and 2 show, with the upper and lower sides bended perpendicularly forming an U shape, with two position holes 211, 212 for two bolts 6 of the knob to go through, with oval-shaped hole 213 for the arc-shaped plate 5 of the knob to go through when this lock is adjusted to the short size, with protrusion 214 at each of the bended walls for catching hold of lid plate 22 through bending said protrusion 214 and with stopping key 215 protruding inward at each end of the bended walls for restricting auxiliary extending plate 33 in the extending-out distance.

Figure 10:
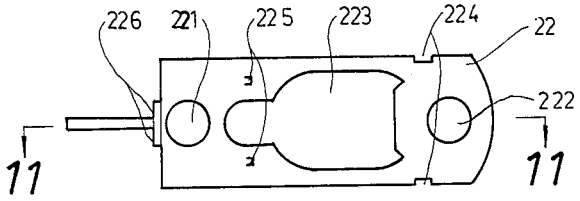
FIG. 10 is a front view of the lid plate in this invention.
Figure 11:
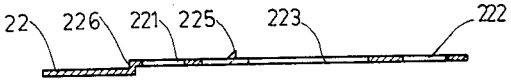
FIG. 11 is the cross-section view on the line 11—11 of FIG. 10.

Lid plate 22, as FIGS. 1 and 10 show, has two notches 224 which are inserted by protrusions 214, and bending said protrusions unites said lid plate 22 and said outer combining plate 21 together as one unit. Lid plate 22 also has position holes 221, 222 and hole 223 with the same function and position as said position holes 211, 212 and hole 213 in said outer combining plate 21. Besides, lid plate 22 has two inward protrusions 225 to stop auxiliary extending plate 33 from moving inside. Combining set 2 cannot move to and fro, because protrusions 214 above and under position holes 212 hook with protrusions 113 and shoulder 217 on outer combining plate 21 pushed against the bottom of lock cylinder 1 after lid plate 22 has been united with outer combining plate 21. In addition, hook 226 pushes against the other end of hole 111 and protrusions 214 are to be bended after being inserted in notches 224, so combining set 2 cannot move right or left either as the thickness of the set 2 is just the same size as the width of hole 111.

Moving set 3 includes moving plate 31, extending plate 32, auxiliary extending plate 33 and releasing plate 34.

Figure 4:
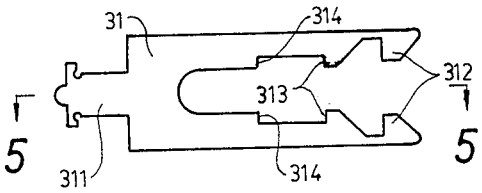
FIG. 4 is a front view of the moving plate in this invention.
Figure 5:
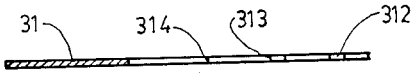
FIG. 5 is the cross-section view on the line 5—5 of FIG. 4.
Figure 7:
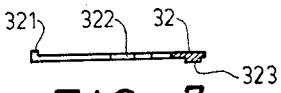
FIG. 7 is the cross-section view on the line 7—7 of FIG. 6.
Figure 9:
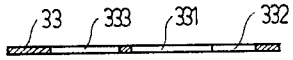
FIG. 9 is the cross-section view on the line 9—9 of FIG. 8.

Moving plate 31 shown in FIGS. 1, 4 has the same structure as that used in common locks. Its neck 311 runs into releasing plate 34, uniting itself with dead bolt 41 as one unit so that dead bolt 41 and releasing plate 34 are to be moved all together once moving plate 31 is moved. On moving plate 31 there is one set of two teeth 312 which is to be moved by the turning of arc-shaped plate 5 of the knob as shown in FIGS. 7, 9. Besides, there is another set of two teeth 313 which is for bended protrusions 321 of extending plate 32 to lean against, and there are set notches 314 in front of two teeth 313 which bended protrusions 321 move into while said protrusions 321 do not lean against said teeth 313.

Figure 6:
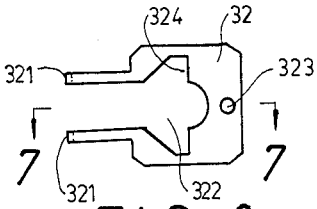
FIG. 6 is a front view of the extending plate in this invention.

Next, if this lock needs to be adjusted to the long size, bended protrusions 321 must be placed to lean against teeth 313 so as to pull moving plate 31. If this lock needs to be adjusted to the short size, bended protrusions have to be moved forward to the front end of notches 314. Besides, on extending plate 32 is bored hole 322 coinciding with teeth 312 in order to enable arc-shaped plate 5 of the knob move extending plate 32 or move both moving plate 31 and extending plate 32 at the same time. In addition, pin 323 set on extending plate 32 can move along guiding hole 331 of auxiliary extending plate 33 and can pull out said plate 33, making said protrusions 321 lean against teeth 313 when this lock is adjusted to the long size. FIGS. 1 and 6 can be referred to.

Figure 8:
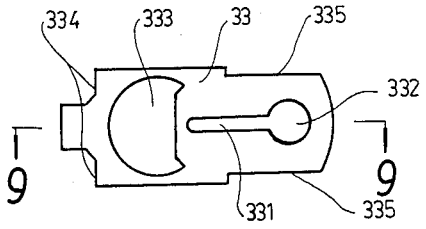
FIG. 8 is a front view of the auxiliary extending plate in this invention.

Auxiliary extending plate 33, as FIGS. 1, 8 show, has guiding hole 331 for pin 323 of extending plate 32 to move along. Said plate 33 also has round hole 332 for bolt 6 of the knob to insert through to stabilize this lock when this lock is to be adjusted to the long size, as FIG. 9 shows. On auxiliary extending plate 33 is also bored hole 333 for arc-shaped plate of the knob to move inside. For the purpose of adjusting this lock to the long or short size, auxiliary extending plate 33 can move inside outer combining plate 21, either being stopped at protrusion 225 of lid plate 22 by means of its shoulder 334 to make up the short size 60 mm, or being stopped at stopping keys 215 by means of higher walls of extending plate 33 to make up the long size 70 mm.

Anti-burglar set 4 includes dead bolt 41, anti-burglar bolt 42, stopping plate 43 and two coil springs 44; all of those parts are of the same structure as those used in common locks, having no relations with the two sizes to be adjusted, so the detail is omitted here.

Figure 12:
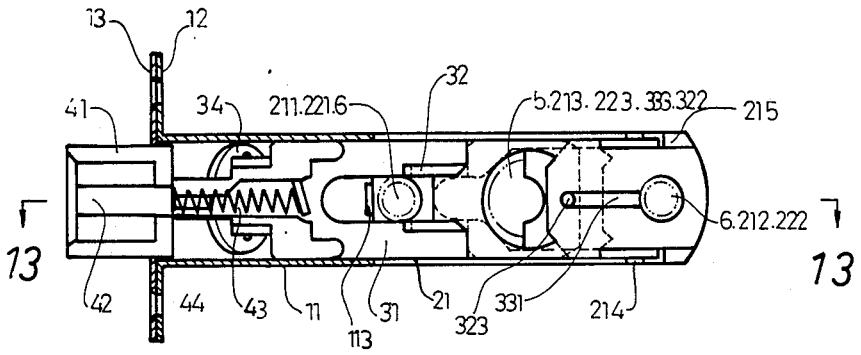
FIG. 12 is a view of this lock adjusted to the short size.
Figure 13:
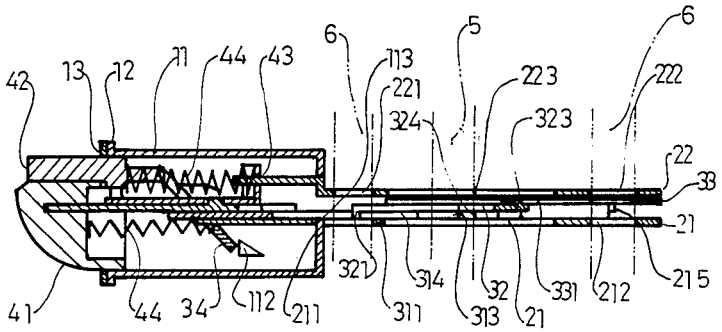
FIG. 13 is the cross-section view on the line 13—13 of FIG. 12.

FIG. 12 shows the positional view of this lock adjusted to the short size. At this position extending plate 32 and auxiliary extending plate 33 as well are pushed inside so that round hole 332 of auxiliary extending plate 33 comes to locate just against position hole 212 of extending plate and position hole 222 of lid plate 22, and besides, hole 333 of auxiliary extending plate 33 comes to locate just against hole 322 of extending plate 32, teeth 312 of moving plate 31, hole 213 of outer combining plate 21 and hole 223 of lid plate 22 as well. Then, arc-shaped plate 5 of the knob can insert into these holes, and lean against teeth 312, and the wall of hole 322. One of two bolts 6 of the knob inserts through round hole 332 and position holes 212, 222; another of two bolts 6 inserts through position holes 211, 221. Then the turning of arc-shaped plate, clockwise or counter-clockwise, can push teeth 312 to move moving plate 31 to the right, and said plate 31 in order moves releasing plate 34 which pulls dead bolt 41 inside because of the limiting of stopping key 112, and this action means the door is opened.

Figure 14:
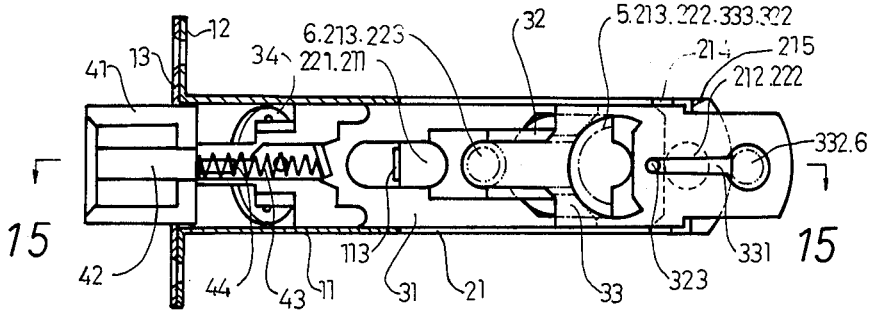
FIG. 14 is a view of this lock adjusted to the long size.
Figure 15:
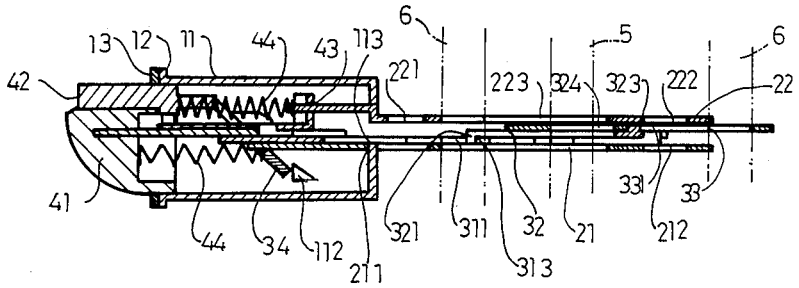
FIG. 15 is the cross-section view on the line 15—15 of FIG. 10.

FIG. 14 shows the positional view of this lock adjusted to the long size. At this position, auxiliary extending plate 33 is pulled outside so that its round hole 332 is exposed outside of outer combining plate 21 and lid plate 22; guiding hole 331 then pulls pin 323 to make extending plate 32 pulled backward so that bended protrusions 321 come to hook against teeth 313 of moving plate 31, but teeth 312 is hidden; hole 322 of extending plate 32 comes to locate just against hole 213 and hole 223 so that arc-shaped plate can go into these holes and lean against perpendicular wall 324 of extending plate 32; besides, one of bolts 6 of the knob can insert through holes 213, 223 to stabilize this lock. Then turning arc-shaped plate of the knob clockwise or counter-clockwise can move in order extending plate 32, moving plate 31 and dead bolt, which is pulled backward at last.

As can be seen in the above description, this lock can be adjusted to two different sizes, commonly called 60 mm and 70 mm according to the structural size of a door in order to be fixed on it. This possibility in changing size can get rid of many inconveniences involved in manufacture, sale and use as well.

What is claimed is:

1. A tubular lock with an adjustable device for fixing the lock in two different sizes comprising, a lock cylinder having a faceplate, a fixing plate and a cylinder which contains inside an anti-burglar set and has a bottom cut with a hole for combining with a combining set, a combining set comprising an outer U-shaped combining plate having two position holes, a hole between said position holes, bent upper and lower sides and a stopping key at each end of the upper and lower sides, and a lid plate which has two position holes and a hole between said position holes as said outer combining plate does, two inward protrusion means to stop the movement of an auxiliary extending plate, and hook means to hook against one end of the hole in said cylinder, a moving set comprising a moving plate, an extending plate and an auxiliary extending plate which are all combined between said outer combining plate and said lid plate, said moving plate having a neck means to combine with a dead bolt, one set of tooth means to be moved by an arc-shaped plate of a knob, and another set of tooth means to be leaned against by two bent protrusions of said extending plate; said extending plate having two protrusion means to lean against a set of tooth means of said moving plate, a hole means to be moved by said arc-shaped plate, and a pin means to insert in and move along a guiding hole of said auxiliary extending plate; said auxiliary extending plate having said guiding hole for said pin means of said extending plate to move inside and to be stopped at its end when a hole of said auxiliary extending plate is located just against a hole of said extending plate, a round hole means for a bolt of the knob to be inserted in, a wall means to move along on two stopping keys and to be stopped at a certain point when retracting, and shoulder means to be stopped by two inward protrusions of said lid plate when moving inward, an anti-burglar set comprising a dead bolt, and anti-burglar bolt, a stopping plate and two coil springs, and having characteristic that inward movement of said auxiliary extending plate can adjust the lock to the short size, activating one hole means of said extending plate to locate against one set of the tooth means of said moving plate so that the arc-shaped plate can fit in and move said hole means of said extending plate and said tooth means of said moving plate, and that outward pulling of said auxiliary extending plate can adjust the lock to the long size, activating said protrusion means of said extending plate to lean against another set of tooth means of said moving plate so that said arc-shaped plate can move said extending plate and then said moving plate.

2. The tubular lock as claimed in claim 1, wherein said outer combining plate has an inward stopping key at each end of the upper and lower sides.

3. The tubular lock as claimed in claim 1, wherein said lid plate has two inward protrusion means to restrict the inward movement of said auxiliary extending plate.

4. The tubular lock as claimed in claim 1, wherein one set of the tooth means on the moving plate is provided with a straight groove at its front for said protrusion means of said extending plate to lean against after moving on said groove.

5. The tubular lock as claimed in claim 1, wherein said extending plate has a hole to be moved by said arc-shaped plate of the knob, two bent protrusions to lean against one set of said tooth means of said moving plate, and a pin means to move in said guiding hole of said auxiliary extending plate.

6. The tubular lock as claimed in claim 1, wherein said auxiliary extending plate has a round hole which comes to locate just against the position holes of said combining set when said plate is pulled outward.

* * * * *